United States Patent [19]

Boose

[11] 4,029,112

[45] June 14, 1977

[54] MUSTACHE KIT

[75] Inventor: Michael Anthony Boose, Chicago, Ill.

[73] Assignee: Lawrence Peska Associates, Inc., New York, N.Y. ; a part interest

[22] Filed: Sept. 8, 1976

[21] Appl. No.: 721,461

[52] U.S. Cl. ..... 132/79 R; 132/10; 132/53

[51] Int. Cl.[2] ..... A45D 40/00

[58] Field of Search ..... 132/79 X, 10, 32 R, 132/34 R, 53, 46; 248/292, 204

[56] References Cited

UNITED STATES PATENTS

| | | | |
|---|---|---|---|
| 549,148 | 11/1895 | McCallum | 132/10 |
| 1,684,091 | 9/1928 | Halk | 132/79 F |
| 1,707,021 | 3/1929 | Lea et al. | 132/79 F |

*Primary Examiner*—G.E. McNeill

[57] ABSTRACT

A kit for a mustache is disclosed comprising a box having a lid, a tray in the box and artificial mustaches, a mustache wax container, mustache adhesive container and scissors supported on the tray.

3 Claims, 3 Drawing Figures

MUSTACHE KIT

SUMMARY OF THE INVENTION

The present invention relates to a mustache kit comprising box means having a lid, a tray in the box, artificial mustaches, scissors, mustache adhesive dispensing containers and a mustache wax dispensing container supported in the tray. Recess areas may be provided in the tray for receiving the mustaches, adhesive dispensing container and wax dispensing container. In a preferred embodiment, the recesses are form fit to receive the artificial mustaches, scissors, mustache adhesive dispensing container and mustache wax dispensing container.

DETAILED DESCRIPTION

Figure 3:
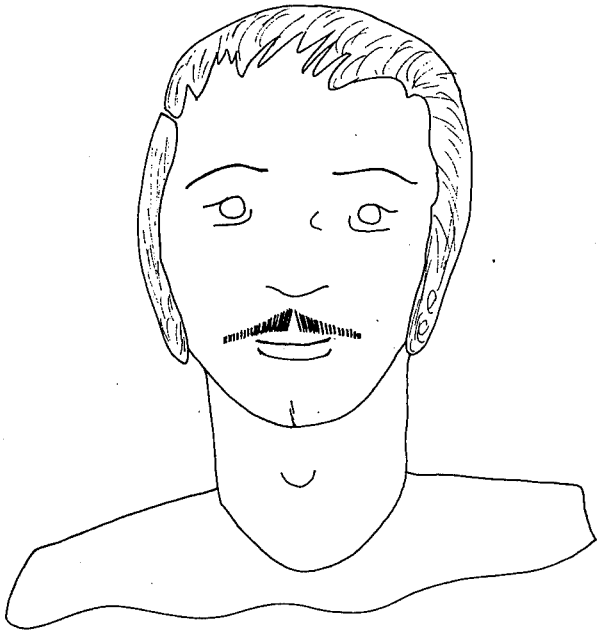
FIG. 3 illustrates types of mustaches obtained from the kit of the present invention.
Figure 1:
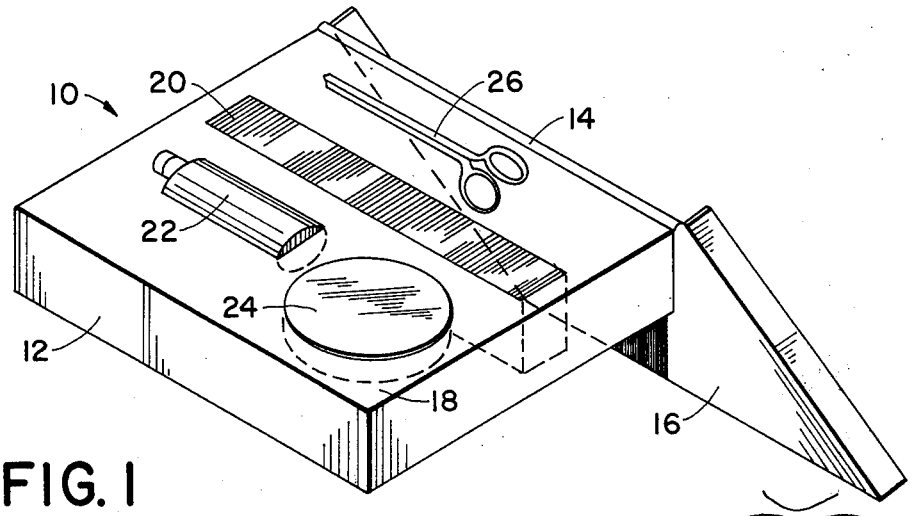
FIG. 1 illustrates a mustache kit according to one embodiment of the present invention.

The present invention relates to a mustache kit having mustaches stacked therein of different sizes, shapes and designs.

The prior art discloses various devices for supporting mustaches such as the apparatus illustrated in U.S. Pat. Nos. 2,517,349 Raditz; 549,148 McCallum; 548,387 Paden; 741,711 Phelan, et al; and, 60,494 Emerson.

It is an object of the present invention to provide a mustache kit that will enable the user of the kit to quickly change mustache colors and styles for different effects. Kits of this type are especially useful for actors or men who wish to change their appearance quickly as a matter of fashion or style and changing trends in appearance.

These and other objects have been achieved according to the present invention and will become apparent from the disclosure and claims that follow as well as the appended drawing.

Referring to the drawings, a mustache kit 10 is illustrated comprising a box 12 having a hinge thereon 14 for hingedly securing lid 16 to box 12, a tray 18 being provided in the box with recesses therein for receiving a plurality of mustaches 20 stacked one on top of the other, the mustaches 20 being of different sizes, shapes and colors. Mustache adhesive dispensing member or container 22 is also provided in a form fit recess in tray 18 to snugly receive the adhesive dispensing container and similarly a form fit recess in tray 18 for mustache wax dispensing container 24 and scissors 14 is also provided for snugly receiving the mustache wax dispensing container 24 and scissors 14.

Figure 2:
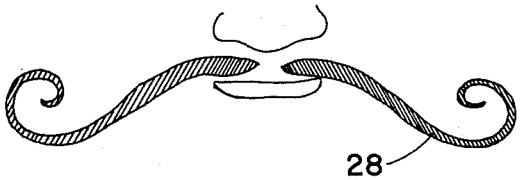
FIG. 2 illustrates a plurality of mustache styles which may be obtained from the kit.
Figure 2:
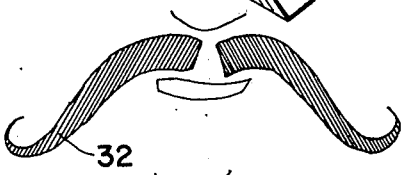
Figure 2:
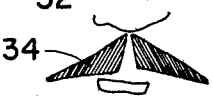
Figure 2:
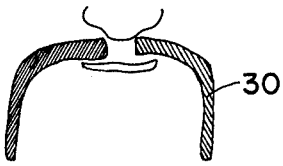
Figure 2:
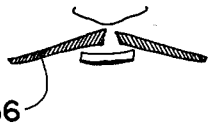

In use, any one of a plurality of mustaches 20 may be adhered to the upper lip by means of adhesive 22 and various styles or colors of mustaches in the kit 20 may be modified by means of scissors 26 so that either a different style may be obtained or the existing style more nearly fit to conform to the shape of the upper lip of the person on whom the mustache is being applied. The various styles of mustaches are illustrated in FIG. 2 such as the styles of mustaches 28, 30, 32, 34 and 36.

Although the invention has been described by reference to some embodiments, it is not intended that the mustache kit be limited thereby but that modifications thereof are intended to be included as falling within the spirit and scope of the foregoing disclosure, the following claims and the appended drawing.

What is claimed is:

1. A mustache kit comprising box means having a lid, a tray means in said box, artificial mustaches, scissors, mustache adhesive dispensing means and mustache wax dispensing means supported on said tray.

2. The mustache kit of claim 1 comprising recess means in said tray for receiving said artificial mustaches, scissors, mustache adhesive dispensing means and mustache wax dispensing means.

3. A mustache kit according to claim 1 comprising box means having a lid, tray means in said box, form fit recesses in said tray for receiving artificial mustaches, artificial mustaches being placed in said recesses therefor, form fit scissor recesses in said tray for receiving scissors and scissors inserted in said recess therefor, form fit mustache adhesive dispensing means in said tray for receiving a mustache adhesive dispensing means and a mustache adhesive dispensing means in said recess therefor, and form fit recess means for mustache wax dispensing means, mustache wax dispensing means being positioned in said recess therefor.

* * * * *